United States Patent [19]

Perez

[11] 4,365,808

[45] Dec. 28, 1982

[54] POLICEMAN'S NIGHT-STICK

[76] Inventor: Sergio J. Perez, 311 W. 97th St., New York, N.Y. 10025

[21] Appl. No.: 244,655

[22] Filed: Mar. 17, 1981

[51] Int. Cl.[3] ..... F41B 15/06

[52] U.S. Cl. ..... 273/84 R

[58] Field of Search ..... 273/67 R, 80 D, 84 R, 273/32 A, 84 ES; 30/164.6; 135/66; 294/61

[56] References Cited

U.S. PATENT DOCUMENTS

| | | | |
|---|---|---|---|
| 350,249 | 10/1886 | Holman | 135/66 |
| 1,179,611 | 4/1916 | Cilley et al. | 273/84 R |
| 3,208,123 | 9/1965 | Koos | 273/32 AX |
| 3,554,546 | 1/1971 | Branhut | 273/84 R |
| 4,098,503 | 7/1978 | Antone | 273/84 R X |

FOREIGN PATENT DOCUMENTS

| | | | |
|---|---|---|---|
| 831626 | 6/1938 | France | 273/84 R |
| 559747 | 3/1944 | United Kingdom | 273/84 R |

*Primary Examiner*—George J. Marlo

[57] ABSTRACT

A policeman's night stick; including a spike affixed to one end of the handle and extending through a tubular shaft; also affixed on the same end of the handle a metal sheath around a pointed end of the spike, being retractable against a compression spring inside the shaft; a thumb receiving ring fitted with a rubber band tethered to the handle; a back hand strap along-side the shaft; and a separate buckle to which the night stick shaft and the ring are magnetically adhered.

2 Claims, 4 Drawing Figures

10
11
12
13
14
15
16
17
18
19
20
21
22
23
24
25
26
27
28
29
30
POLICE DEP

POLICEMAN'S NIGHT-STICK

SUMMARY OF THE INVENTION

This invention relates generally to policeman's night sticks.

A principle object of the present invention is to provide a policeman's night stick that is more efficient when used to subdue an attacker or aggressive criminal, by including a jabbing means that can be selectively used when desired.

Another object is to provide a policeman's night stick that is magnetically secured to a clip on a policeman's belt, so that it can be more quickly removed therefrom for instant use, when needed.

Yet another object is to provide a policeman's night-stick that includes a finger receiving ring and a back hand elastic strap to prevent the stick from being accidentally dropped, in case the policeman's grasp thereof is momentarily released, such as during a scuffle.

PREFERRED EMBODIMENT

Figures 1, 2, 3, 4:
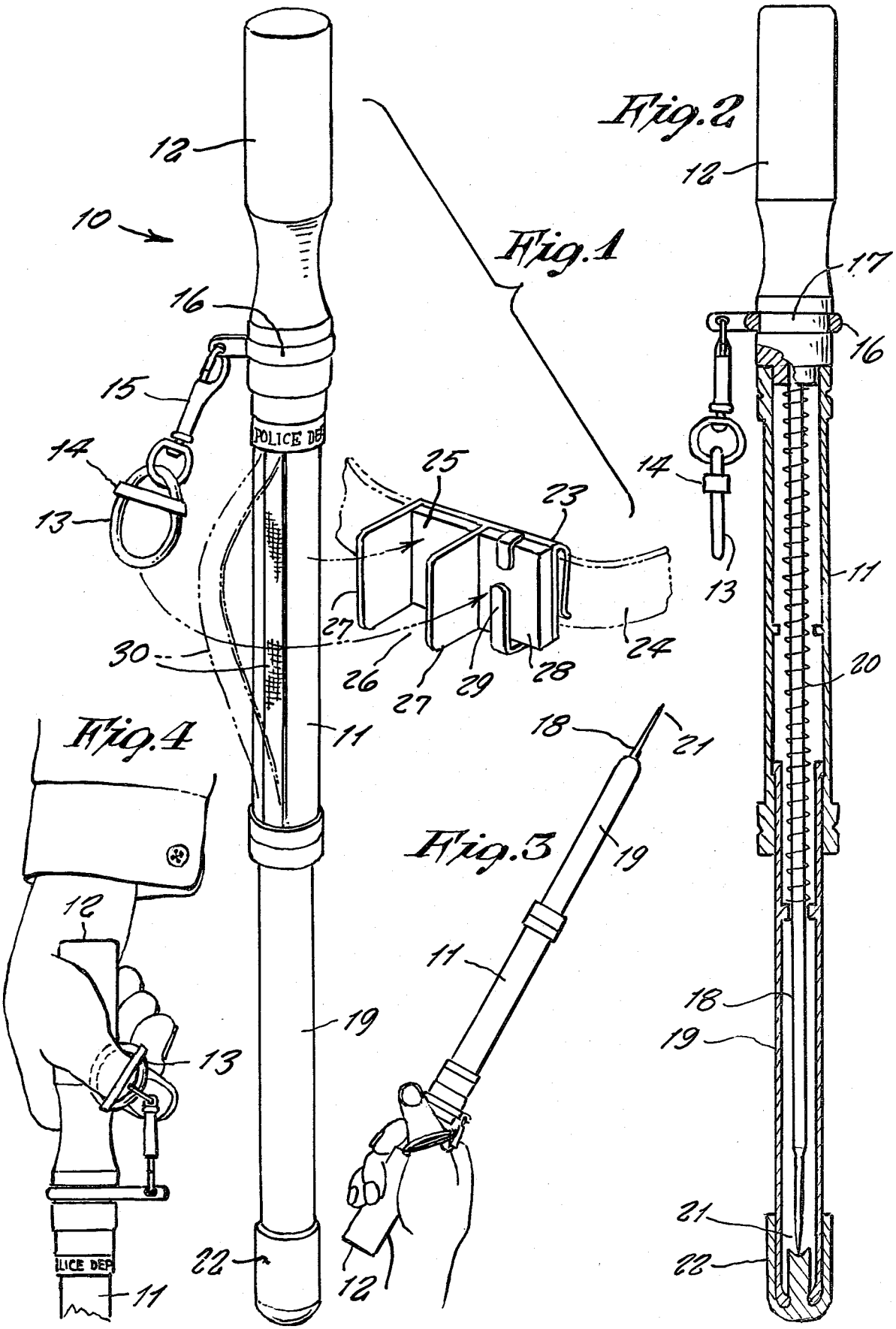
FIG. 1 is a perspective view of the policeman's night stick, and a belt clip on which it is magnetically held when carried by a policeman.
FIG. 2 is a side cross sectional view thereof.
FIG. 3 shows the night stick in jabbing use.
FIG. 4 is a detail view showing the policeman's thumb engaged through the ring, while holding the night stick handle.

Referring now to the drawing in greater detail. The reference numeral 10 represents a policeman's night stick according to the present invention, wherein there is a tubular steel shaft 11 which at one end is fitted with a hardwood handle 12.

A thumb receiving metal ring 13, fitted with a rubber band 14 that is bonded diametrically therearound; suspended from a conventional clip 15 hung from a metal band 16, retained in an annular groove 17 around a base end of the handle. The rubber-band serves to frictionally bear the thumb against an inner edge of the ring.

A long steel spike 18 is secured at one end in the handle, and extends through the shaft 11 and into a tubular steel sheath 19, which is slidable inside the shaft 11, against the action of a compression coil spring 20 and thus expose a pointed end 21 of the spike, if the night stick is jabbed against a person or object. As the policeman's hand holding the handle 12, pushes the night stick against a person, the terminal end of the sheath 19 stops against the outer surface of the person, unless pushed harder. When the handle is thereafter pulled rear-wardly from the person, the sheath automatically enclose the spike.

A removable end cap 22 made of metal, frictionally fits on the end of the sheath, and prevents exposing the spike when the night stick is otherwise being used for purposes other than jabbing.

The night stick can be carried by the policeman by supporting it magnetically from a clip 23, that is hooked over a policeman's belt 24. It includes a magnet 25 in a recess 26 formed between flanges 27 to magnetically grasp the night stick's steel shaft, and from which it can be quickly released for immediate use simply by shoveling the night stick forwardly. Another magnet 28 is fitted with a hook 29 in front thereof, and the ring 13 may be hooked thereupon.

An elastic strap 30 along a side of the shaft serves as a back hand securement for a policeman's hand grasping the night stick when in use.

I claim:

1. A policeman's night stick, comprising in combination: a tubular steel shaft secured at one end to a hardwood handle from which a steel spike protrudes through said shaft; a compression coil inside said shaft, retaining a slidable sheath around a pointed end of said spike; and a removable end cap on said sheath, for preventing retractable sliding of said sheath and exposure of said spike's pointed end; a thumb receiving ring suspended from said handle; a rubber band bonded diametrically across said ring for holding a thumb against an inner edge of said ring; an elastic back hand strap along a side of said shaft; and a belt clip with magnetic means for holding said night stick thereto.

2. The combination as set forth in claim 1; wherein said magnetic means comprises a first magnet located between forwardly projecting flanges for said shaft to magnetically adhere thereto; and a second magnet adjacent one of said flanges, having a upward hook for receiving said ring.

* * * * *